United States Patent [19]

Kihnke et al.

[11] 4,194,341

[45] Mar. 25, 1980

[54] HAND OPERATED FILLING AND SEALING DEVICE

[75] Inventors: Lee S. Kihnke; Gary Kruse, both of Spring Lake, Mich.

[73] Assignee: JSJ Corporation, Grand Haven, Mich.

[21] Appl. No.: 857,426

[22] Filed: Dec. 5, 1977

[51] Int. Cl.[2] ..... B65B 3/06

[52] U.S. Cl. ..... 53/282; 53/329; 141/174; 141/190; 198/859

[58] Field of Search ..... 53/282, 287, 296, 329, 53/390; 141/174, 183, 190; 198/656, 859

[56] References Cited

U.S. PATENT DOCUMENTS

| | | | |
|---|---|---|---|
| 1,789,051 | 1/1931 | Opitz | 141/174 X |
| 1,793,158 | 2/1931 | Clayton | 198/859 X |
| 2,153,039 | 4/1939 | Darling | 53/329 |
| 3,279,652 | 10/1966 | Willvonseder | 221/223 |
| 3,286,437 | 11/1966 | Cole | 53/329 X |
| 3,738,082 | 6/1973 | Anderson | 53/329 |
| 3,965,656 | 6/1976 | Gerben | 53/282 |

*Primary Examiner*—Robert D. Baldwin

*Attorney, Agent, or Firm*—Price, Heneveld, Huizenga & Cooper

[57] ABSTRACT

This specification discloses a manually operated portion packaging apparatus including an operating handle initiating and actuating each step in a sequence of steps to complete packaging of a portion of a substance such as food. A hand operated handle advances a conveyor carrying containers, causes a film dispenser to dispense sufficient amount of heat sealable film, causes a heated platen to press on a container covered by the film, and actuates a food dispenser and container dispenser. Manually powering such a machine reduces the cost in comparison to electrical powering yet substantially increases efficiency in comparison to manual execution of each step in the portion packaging sequence.

18 Claims, 8 Drawing Figures

HAND OPERATED FILLING AND SEALING DEVICE

BACKGROUND OF THE INVENTION (1) Field of the Invention

This invention relates to an apparatus for packaging portions of a substance such as food within sealed packages.

(2) Prior Art

Food products can be packaged in individual portions using containers of a material such as molded plastic with heat sealed plastic film or aluminum foil covers. These containers protect the food against oxidation and moisture loss.

Individual filling of each container by hand and individual sealing of the container by hand is known. This is a very slow method and relatively expensive because of the labor involved. Accordingly, such hand packaging is useful for applications requiring only the smallest of quantities.

Automatic machines for filling and sealing containers are also known, but most of these machines are complicated in their construction and represent a substantial monetary investment. Accordingly, such machines are suitable for applications requiring large numbers of packaged portions where the cost of such a machine can be justified. Automatic machines can, for example, fill 160 containers per minute and can initially cost in the neighborhood of $60,000.00.

There is a lack of an apparatus which costs considerably less than a fully automatic machine, yet packages individual portions considerably faster than manually doing each step in the packaging sequences. Thus it relieves a user, not large enough to fully justify an automatic machine, of the expense of such a machine and provides an alternative to the high labor costs of completely manual packaging. These are some of the problems this invention overcomes.

SUMMARY OF THE INVENTION

A manually operated portion packaging apparatus includes a handle means for initiating step positioning of a container and sealing of the container thereby facilitating packaging portions of a substance. In accordance with one embodiment of this invention, a manually operated handle initiates the entire operation of filling and sealing a container by actuating movement of a conveyor means through a container dispensing station, a container filling station, and a container sealing station.

A machine in accordance with an embodiment of this invention fills the gap between individual hand filling of portion containers and completely automatic filling and sealing of portion containers. This invention recognizes that a hand operated machine can be used for this purpose. For example, certain institutions such as hospitals and smaller schools can find that a filling rate such as fifteen containers per minute is desirable and can be achieved using this invention. The cost of a machine, in accordance with an embodiment of this invention, can be in the neighborhood of about one-tenth of the cost of a completely automatic, complex filling machine thus making elimination of completely manual filling and sealing financially feasible for a greater number of institutions. Use of this machine permits a lower initial capital cost in comparison to a completely automatic machine and a higher productivity per person in comparison to completely manual packing and sealing. Inasmuch as the cost of the package and the cost of the food or other substance being packaged are fixed in a particular situation, the labor and capital costs associated with packaging are the controllable variables in the cost and pricing of the portion packages. Thus, the machine in accordance with an embodiment of this invention is particularly advantageous in situations where the capital cost of the automatic machines has been too high and the output of hand packing has been too low in view of the labor cost.

DETAILED DESCRIPTION OF THE INVENTION

Figure 1:
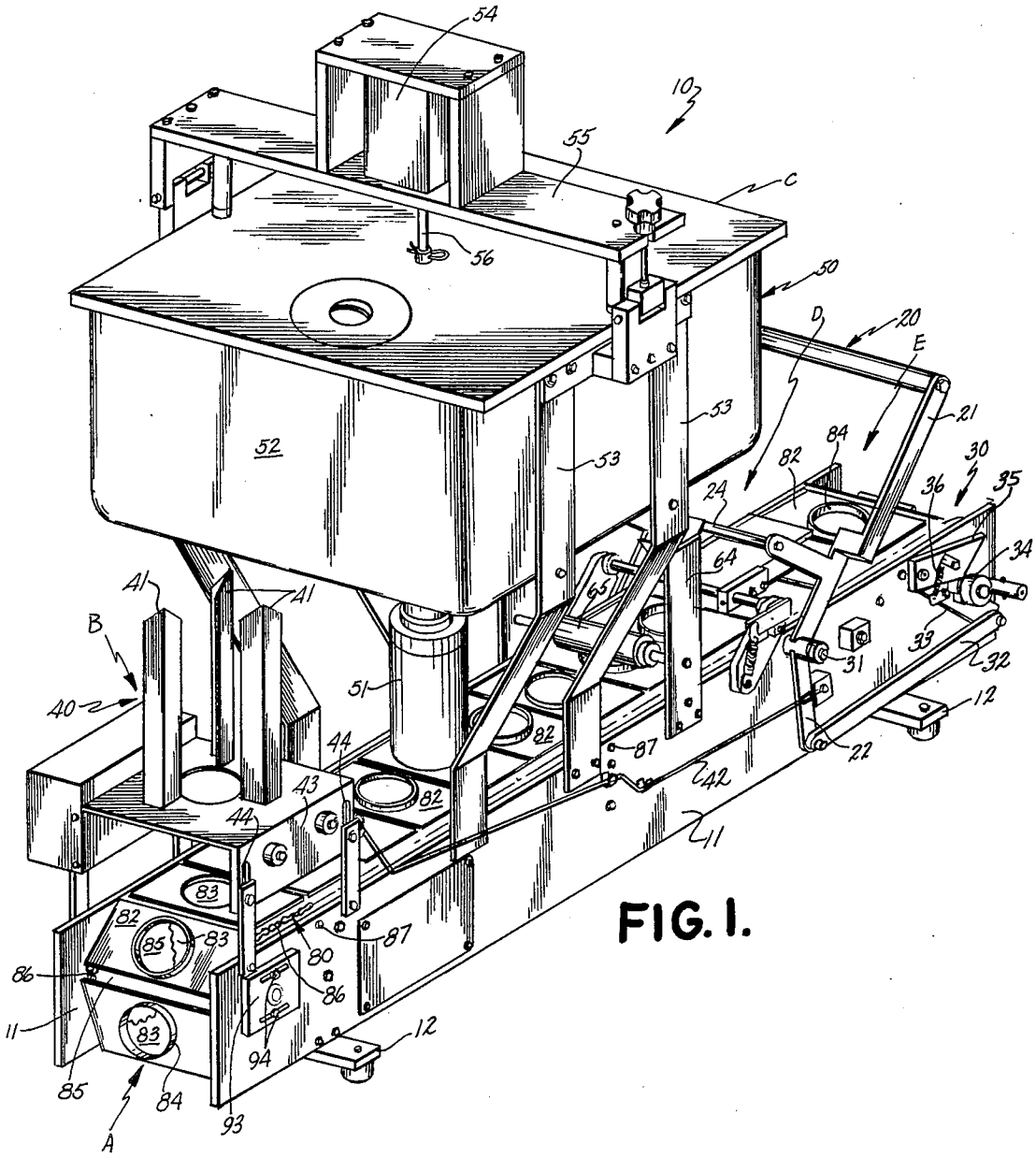
FIG. 1 is a perspective view of a manually operated portion packaging apparatus in accordance with an embodiment of this invention.

Referring to FIG. 1, the portion packaging apparatus includes a conveyor A; container supply station B, where the container, such as a cup, is placed on the conveyor; a filling dispenser station C at which the filling material, such as a juice, is dispensed into the container; a sealer station D, which seals a film over the top of the container; a shearing device and a removal or outlet station E at where the filled and sealed container is removed.

Figure 6:
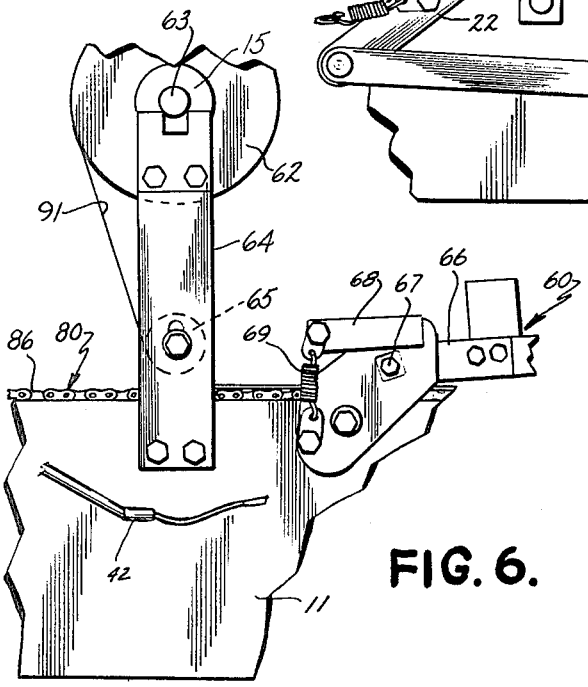
FIG. 6 is a side elevation view including a sealing film dispenser and the sealing station.
Figure 4:
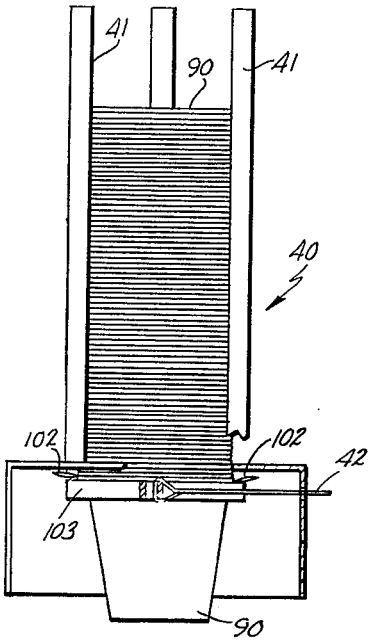
FIG. 4 is a side elevation view, partly broken away of the denesting station including a ring gear activated by a cable.

Referring more specifically to FIG. 1, the portion packaging apparatus 10 includes a pair of parallel, elongated, generally rectangular siderails 11 which are mounted on a pair of feet 12, one foot being adjacent each extremity of siderails 11. An endless conveyor 80 is supported between siderails 11 and includes a plurality of plates 82 for carrying cup-shaped containers 90 (FIG. 4). An operating handle 20 is coupled to a stepping apparatus 30 mounted on siderails 11 which advances conveyor chain 80. Operating handle 20 is also coupled to a container dispenser and denester 40 at the container supply station, a liquid dispenser 50 at the filling dispenser station, and a heat sealing apparatus 60 (FIGS. 2 and 6) located at the sealer station. Operating handle also causes the cups to be moved out of the normal position on the conveyor for easy removal. Containers 90 are stepped through the stations B, C, D, and E by the actuation of operating handle 20.

CONVEYOR AND OUTLET STATION

Figure 7:
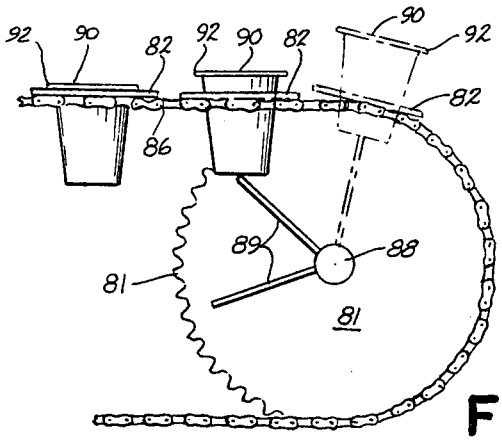
FIG. 7 is a side elevation view, partly broken away, of the removal or outlet station including two positions of a lifting finger for removing a cup from the conveyor.

Endless conveyor 80 includes a pair of endless drive chains 86 each one being positioned along a top portion of siderail 11 and completing a loop along a bottom portion of siderail 11. Each of drive chains 86 is supported by a sprocket wheel 81 (shown partially in FIG. 7) positioned at the end of siderail 11 adjacent operating handle 20. Each drive chain 86 is supported by an adjustable sprocket wheel 85 (shown partially in FIG. 1) at the other end of siderail 11 from sprocket wheels 81. Each sprocket wheel 85 is rotationally mounted on a sliding adjustment block 93 (FIG. 1) coupled to the outside of siderail 11 and secured thereto by bolts 94 (FIG. 1). Drive chain 86 is supported along its top run by bolts 94 (FIG. 1). Drive chain 86 is supported along its top run by rollers mounted on a plurality of cross shafts 87 (shaft ends shown in FIGS. 1, 2 and 3) which extend between siderails 11 and also support siderails 11 relative to one another. A plurality of generally rectangular plates 82 are mounted between drive chains 86 and coupled at each side to drive chain 86. Advantageously, each plate 82 is coupled at a single, central portion of each side of plate 82 to drive chain 86 so the leading and lagging edge of plate 82 can separate from drive chain 86 as drive chain 86 goes around sprocket wheels 81 and sprocket wheels 85. Each plate 82 has a central circular opening 83 (FIGS. 1 and 7) with a flared, top rim 84, to form sockets for receiving containers 90. Containers 90 are generally cylindrical with a taper from top to bottom and have an outwardly extending circular top flange 92 (FIG. 7) adapted to seat on top rim 84 of plate 82. A shaft 88 mounted between sprocket wheels 81 includes circumferentially spaced, radially protruding fingers 89 (FIG. 7) adapted to enter openings 83 of conveyor chain plates 82 to engage and eject the filled and sealed containers 90. The ejected containers can be received by the operator of portion packaging apparatus 10 or drop into a discharge tray.

Figure 2:
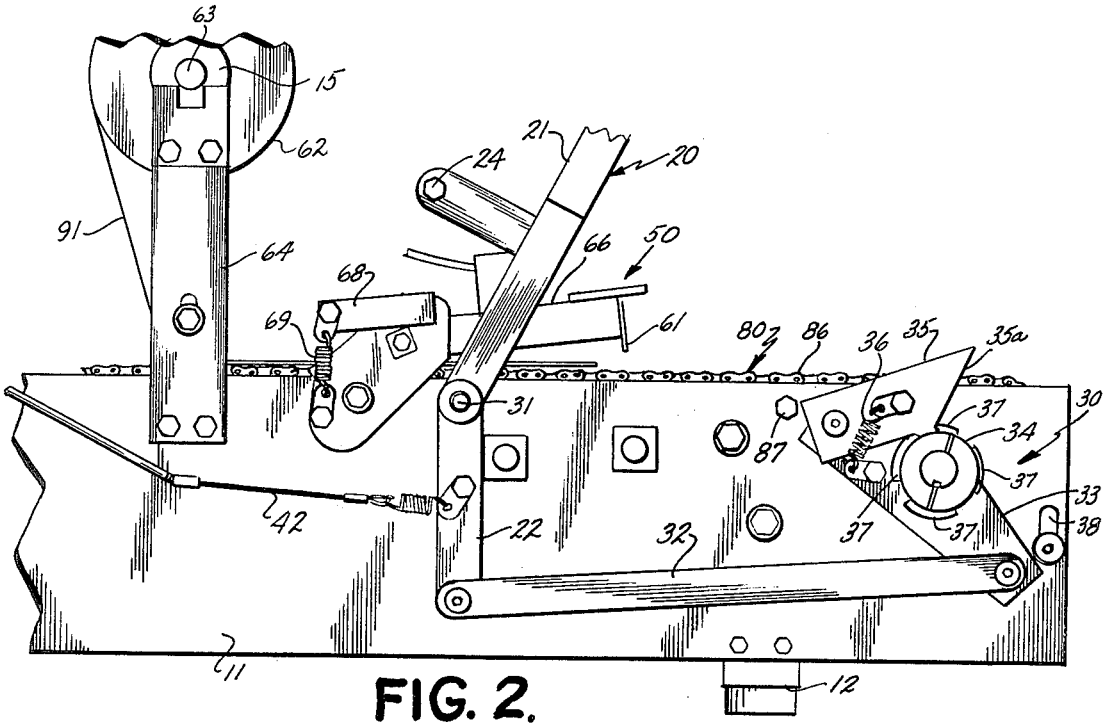
FIG. 2 is a side elevation view of a portion of the apparatus of FIG. 1 including the operating handle, a conveyor chain, a ratchet, a pawl coupling the operating handle to the ratchet, a sealing film dispenser and a sealing station, the operating handle being positioned in an up position.
Figure 3:
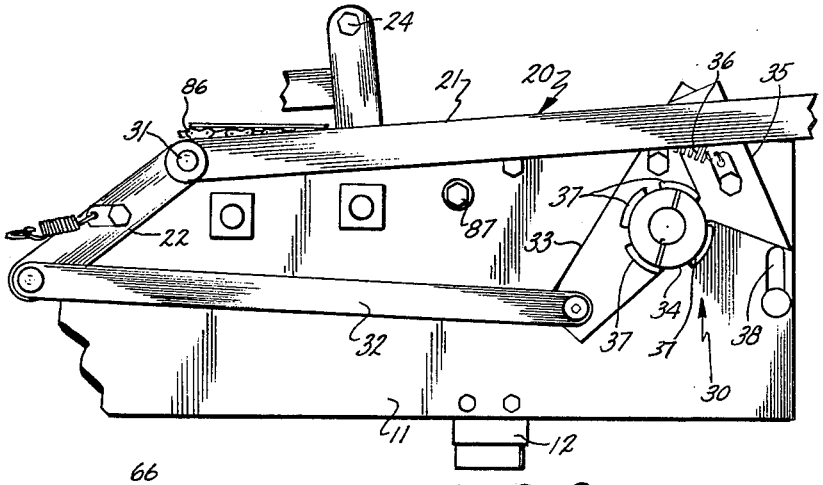
FIG. 3 is a side elevation view of a portion of FIG. 2 including the ratchet, the pawl and with the operating handle in a down position.

The coupling between operating handle 20 and conveyor 80 is stepping apparatus 30 best seen in FIGS. 2 and 3. Handle 20 pivots about a cross shaft 31 passing through and between siderails 11 and dividing handle 20 into an integral upper portion 21 and an integral lower crank portion 22. Crank portion 22 is angled with respect to upper portion 21 and extends generally vertically down the side of siderails 11 when handle 20 is in an up position. The bottom extremity of crank portion 22 is pivotally connected to a link bar 32 which extends along the side of siderail 11 towards the discharge or operator end of apparatus 10 and is pivotally connected at the other extremity to a link bar or actuator 33. Actuator 33 is pivotally mounted on siderail 11 about the same axis as a ratchet 34 which is located at the central portion of actuator 33. A pawl 35 is pivotally mounted on actuator 33 at the extremity opposite from link bar 32. Ratchet 34 is secured to sprocket wheel 81 so rotation of ratchet 34 produces rotation of sprocket wheel 81 and movement of conveyor chain 80 in a downstream direction. A spring 36 biases pawl 35 in a direction against ratchet 34 so that upon rotation of actuator 33, by the handle 20, ratchet 34 is rotated to produce a downstream motion of conveyor chain 80.

Ratchet 34 has four teeth 37, one of which is engaged by pawl 35 each time handle 21 is actuated from the up to down positions. This causes rotation of ratchet 34 and downstream movement of conveyor chain 80. The teeth 37 have curved, trailing edges to permit sliding of pawl 35 over them when the handle is actuated from down to top positions. When rotating ratchet 34 in a clockwise direction as viewed in FIG. 2, pawl 35 remains in engagement with teeth 37 sufficiently long to move conveyor chain 80 a distance equal to the width of a plate 82 along drive chain 86 or "one step". As a result, the plates 82 and the containers 90 therein are moved from one operating station to the next; for example, from the station including liquid dispenser 50 to the station including heat sealing apparatus 60. A stop 38 (FIGS. 2 and 3) protrudes from the side of siderail 11 and into the path of pawl 35 when ratchet 34 has been rotated one step. Continued downward motion of operating handle 20 causes pawl 35, which has an inclined edge 35*a*, to slide onto stop 38 and off the engaged tooth 37 thus stopping further rotation of ratchet 34. Return of operating handle 20 to an upright position causes pawl 35 to ride over teeth 37 without causing backward rotation of ratchet 34. If desired, another pawl, either external or internal to ratchet 34, can be provided to engage teeth 37 to prevent backward rotation of ratchet 34.

CUP SUPPLY STATION

As shown in FIGS. 1 and 4, empty containers 90 are nested one within the other and stacked between three elongated, vertical guide bars 41 of denester 40. Generally, denester 40 has a plurality of oscillatable cam members 102 driven from a common ring gear 103 and adapted to dispense cups in response to angular reciprocation of the ring gear. The specific structure and operation of the denester 40 is disclosed in U.S. Pat. No. 3,279,652 issued on Oct. 18, 1966 to E. Willvonseder and entitled CUP DISPENSER HAVING A PLURALITY OF SIMULTANEOUSLY ACTING CIRCUMPASED OSCILLATING CUP EJECTORS, the disclosure of which is herein incorporated by reference.

Operating handle 20 is coupled to the denester 40 by a cable 42 between lower portion 22 of handle 20 and the common ring gear of denester 40 (FIG. 1). As disclosed in U.S. Pat No. 3,279,652 the ring gear is biased in a first position wherein the bottommost cup is separated by cams from the adjacent above cup. Lifting operating handle 20 causes downward rotation of lower portion 22 and pulling of cable 42 which overcomes the spring biasing forces on the ring gear and rotates the ring gear so the bottommost cup is released to fall into an aligned opening 83 directly below denester 40. Denester 40 is mounted above siderails 11 by a pair of side plates 43 which have vertical elongated openings 44 for adjusting the height of denester 40 above conveyor chain 80 (FIG. 1). thus, the height of denester 40 above conveyor chain 80 can be adjusted to dispense containers of varying height.

FILLER DISPENSING STATION

Figure 5:
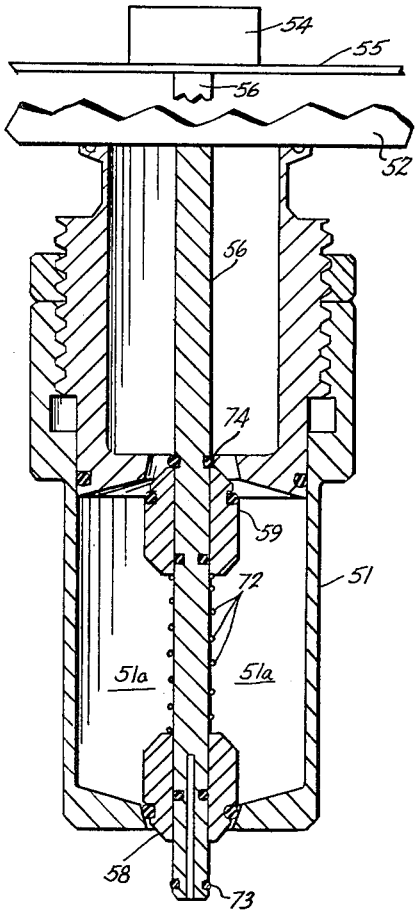
FIG. 5 is a cross section view of the filling station.
Figure 8:
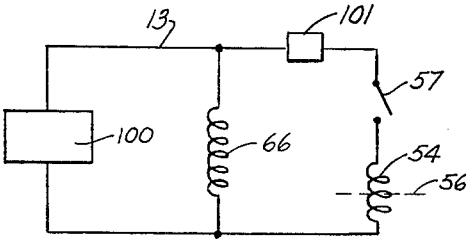
FIG. 8 is a circuit diagram including a limit switch activated by the handle for initiating operation of the dispensing station.

Downstream of the cup supply station is filler dispensing station which includes the liquid dispenser 50 having a dispenser outlet chamber 51 (FIGS. 1 and 5) positioned a distance equal to the width of four plates 82 downstream from denester 40. Outlet chamber 51 is positioned to be centered directly above a container 90 within opening 83 of plate 82. A storage tank 52 is positioned above and in communication with outlet chamber 51. Storage tank 52 is mounted on siderails 11 by braces 53. Outlet 51 includes an interior volume space 51*a* equal to the amount of volume desired to be filled into container 90. A valve 58 at the bottom of outlet 51 releases liquid from outlet 51 and a valve 59 at the top of outlet 51 releases liquid from storage tank 52 into outlet 51. Both of the valves are actuated along a common valve rod 56 which extends through storage tank 52 to a solenoid 54 positioned above storage tank 52 on a cross brace 55 (FIGS. 1 and 5). Valve rod 56 is located concentrically to outlet chamber 51 and is actuated axially by solenoid 54 which in turn is actuated by the opening and closing of a limit switch 57 (FIG. 8) positioned on sidewall 11 to be engaged by upper portion 21 of operating handle 20 when handle 20 is in a down position. Each of the valves 59 and 58 at the top and bottom of outlet 51 have elements slidably mounted on the rod and biased in opposite directions towards the ends of the rod by a spring 72. Also located on the rod is a first ring 74 and a second ring 73 for applying a force against the first valve 59 and the second valve 58, respectively. As shown in FIG. 5, when valve rod 56 is forced downward by solenoid 54, the first ring 74 pushes the first valve 59 off the seat of the first port, between storage tank 52 and outlet 51, thus permitting the liquid in storage tank 52 to flow into outlet chamber 51. When solenoid 54 is energized to pull valve rod 56 upwardly, second ring 73 pulls the second valve element 58 upwardly releasing the liquid through the second port at the bottom of outlet chamber 51 into container 90. The spring 72 then forces the first valve 59 to close the first port thus preventing liquid from flowing from storage tank 52 into outlet chamber 51.

Different sized containers 90 can be accommodated by changing the volume space 51*a* of outlet chamber 51. A particularly desirable way of accomplishing this is to insert doughnut-shaped spacers into volume space 51*a* of outlet chamber 51 which take up some of the space in output chamber 51 thereby reducing space to be filled by the liquid to be dispensed.

SEALER STATION

Heat sealing apparatus 60 includes a roll 62 (FIGS. 2 and 6) of sealing film 91 positioned on a cross bar 63 supported above siderails 11 by braces 64. Further down braces 64 from cross bar 63 is a roller 65 (FIG. 6) extending between braces 64 and guiding sealing film 91 to change directions from generally downward to forward along conveyor chain 80. The roll of sealing film 91 is maintained in an aligned relationship with respect to conveyor chain 80 by a pair of adjustable collar members 15 (FIG. 2) positioned on cross bar 63 adjacent the axial edges of roll 62. Braces 64 are positioned just downstream of liquid dispenser 50.

Just downstream of braces 64 is a pivotally mounted heat sealing element 66 (FIGS. 2 and 6) rotationally movable to a retracted or inoperative position displaced from a container 90 and conveyor chain 80, and to an operable position wherein there is a pressing engagement with sealing film 91 and container 90. Heat sealing element 66 is pivoted above a cross bar 67 and has a pair of extensions 68 extending upstream of cross bar 67 and coupled to siderails 11 by a spring 69 which tend to bias heat sealing element 66 in an inoperative position. A cross bar 24 (FIGS. 2 and 3) extends between upper portions 21 of operating handle 20 to clear heat sealing element 66 when operating handle is in an up position and to pivot heat sealing element 66 to an operative position when operating handle 20 is down. Heat sealing element 66 is connected by an electrical cable 13 (FIG. 8) to a power source 100 for raising the temperature of heat sealing element 66. In a downwardly pivoted position, heat sealing element 66 heats sealing film 91 to a predetermined temperature for sealing film 91 to the upper surface of a container 90. A cutting edge 61 (FIG. 2) is coupled to heat sealing element 66 and positioned to sever sealing film 91 adjacent the leading edge of the container 90 being sealed. Cutting edge 61 can have either a knife or a serrated edge and can be heated for added effectiveness in cutting film 91.

Limit switch 57 can be connected to a timer 101 (FIG. 8) which gives an indication, such as a sound, to the operator of packaging apparatus 10 that operating handle 20 has been depressed sufficiently long to fill a container 90 and to seal a container 90. That is, handle 20 must be held in a position sufficiently long for outlet chamber 51 to empty and for sealing film 91 to be secured to container 90 by heat sealing element 66.

A typical material for portion packaging apparatus 10 is steel. However, for use for food packaging, stainless steel may be particularly desirable. Sealing film 91 can be a thermoplastic or an aluminum film. Containers 90 can be molded of plastic material.

OPERATION

Portion packaging apparatus 10 is operated by the movement of operating handle 20. Each complete downward movement of operating handle 20 causes ratchet 34 to rotate sufficiently to move endless conveyor chain 80 downstream the width of one plate 82. Thus the opening 83 in each of plates 82 is successively aligned with the stations containing apparatus such as denester 40, liquid dispenser 50 and heat sealing apparatus 60. The spacing between these various stations can be any integral number of plates 82 and in this case there are four plates between denester 40 and dispenser 50 and five plates between liquid dispenser 50 and heat sealing element 66.

To begin operation, denester 40 is loaded with a stack of containers 90 betweeen guide bars 41. Storage tank 52 is filled with a liquid to be dispensed. However, solenoid 54 is not actuated until there is a container 90 aligned with it. That is, when operation is starting up, the first four plates 82 will not have containers 90. A roll 62 is placed on cross bar 63 to supply sealing film 91.

Beginning with operating handle 20 in an up position as shown in FIGS. 1 and 2, downward movement of handle 22 to a down position shown in FIG. 3, causes ratchet 34 to rotate sufficiently to move conveyor chain 80 the distance of the width of one plate 82. Upper portion 21 of operating handle 20 strikes limit switch 57 which in turn actuates solenoid 54 to release the liquid within outlet chamber 51 to a container 90 aligned below outlet chamber 51. Cross bar 24 of handle 20 applies heat sealing element 66 to film 91 on a container 90. Cutting edge 61 separates film 91 at a position downstream of a plate 82 at the heat sealing station.

When operating handle 20 has been held down sufficiently long, such as when a buzzer is sounded by a timer 101 having a delay adjusted to insure sufficient time for filling and sealing, handle 20 is raised to an upward position and pivoted about cross shaft 31. As operating handle 20 pivots upward, lower portion 22 pivots downward and forward thus pulling cable 42 and releasing one container 90 from denester 40. The released container 90 drops into an aligned opening 83 of a plate 82. Upward movement of operating handle 20 also removes cross bar 24 from applying pressure to heat sealing element 66 so that heat sealing element 66 pivots upward about cross bar 67 due to the biasing of spring 69.

Subsequent and downward motion of handle 20 again causes ratchet 34 to turn enough to move conveyor chain 80 the distance of the width of one plate 82. When conveyor chain 80 moves, sealing film 91 is still connected to the container 90 which has just been sealed below heat sealing element 66. As a result, roll 62 unwinds and sealing film 91 is positioned above the container 90 to be next sealed by heat sealing element 66.

By use of portion packing apparatus 10, one operator can rapidly fill and seal a plurality of containers 90. If desired, liquid dispenser 50 can be removed and either a different kind of dispenser installed or manual filling by using a spoon or ice cream scoop or the like can be used. Fingers 89 rotate in conjunction with movement of conveyor chain 80 and lift up containers 90 for easy removal.

Various modifications and variations will no doubt occur to those skilled in the art to which this invention pertains. For example, the particular shape of opening 83 and plate 82 may be varied from that disclosed herein. Similarly, the relative spacing between the various stations along the conveyor chain may be varied from that disclosed herein. These and all other variations which basically rely on the teachings through which this disclosure has advanced the art are properly considered within the scope of this invention.

The embodiments of the invention in which an exclusive property or privilege is claimed are defined as follows.

1. A manually operated portion packaging apparatus for denesting, filling and sealing of a container in a sequential series of manually initiated step operations, said portion packaging apparatus including:

a handle means positionable between an up and a down position for initiating said step operations, a complete cycle of said handle means including movement of said handle means from said up position to said down position and back to said up position, said cycle being repeated for sequential operations of said portion packaging apparatus;

a rotatable endless conveyor means having a plurality of container receiving means therein and movable in a downstream direction;

coupling means for intermittently moving said conveyor means one step in response to movement of said handle means from said up position to said down position;

a container dispenser means positioned above one of said container receiving means when said handle means is in said down position and coupled to said handle means so that one container is released when said handle is moved from said down position to said up position;

a material dispenser means positioned above an other of said container receiving means while said container dispenser means is positioned above said one container receiving means and when said handle means is in said down position and coupled to said handle means so that when said handle is in said down position, a predetermined quantity of the material from said material dispenser means is released and deposited in said other container carried by said conveyor chain;

a sealing means for closing a filled container, said sealing means including a sealing film dispenser for positioning a sealing film on still an other container while said container dispenser means is positioned above said one container receiving means, said sealing means also including a heating element for applying heat to said sealing film positioned on a container, said heating element being coupled to said handle means so said heating element is in an inoperable position displaced from said sealing film when said handle means is in an up position and said heating element is in an operable position contacting said sealing film when said handle means is in a down position; and a cutter means for cutting said sealing film downstream of said operable position of said heating element, said cutter means coupled to said handle means so as to be positioned in an inoperable position displaced from said sealing film when said handle means is in an up position and positioned in an operable position adjacent said sealing film when said handle means is in a down position.

2. A manually operated portion packaging apparatus as recited in claim 1 wherein:

said portion packaging apparatus includes a frame means for mounting said handle means and said conveyor means;

said conveyor means includes a pair of parallel, spaced drive chains and a plurality of generally rectangular plates supported between said pair of drive chains, said plates including said container receiving means; and said coupling means includes a sprocket wheel mounted on said frame means and engaging at least one of said drive chains for transmitting a driving force to said conveyor means, a ratchet rotationally coupled to said sprocket wheel, a pawl for engaging and driving said ratchet, and a lever means for coupling said pawl to said handle means so that movement of said handle from said up to said down position causes said ratchet to turn sufficiently to move said conveyor means downstream the distance between the centers of adjacent container receiving means.

3. A manually operated portion packaging apparatus as recited in claim 2 wherein said coupling means further includes:

a stop means for releasing said ratchet from said pawl, said stop means being positioned to release said ratchet when said ratchet has turned sufficiently to move said conveyor means the distance between the centers of adjacent container receiving means; and a spring means for biasing said pawl toward said ratchet, said spring means being coupled between said pawl and said lever means.

4. A manually operated portion packaging apparatus as recited in claim 2 wherein:

said heating element is pivotally coupled to said frame means and spring biased to said inoperable position; and said handle means includes a crossbar which engages said heating element when said handle means is moved from said up to said down position thereby pivoting said heating element to said operable position.

5. A manually operated portion packaging apparatus as recited in claim 1 wherein:

said container dispenser means is coupled by a cable to said handle means so that movement of said handle means through a complete cycle releases one container to be positioned in said one of said container receiving means in said conveyor means.

6. A manually operated portion packaging apparatus as recited in claim 1 wherein:

said material dispenser means includes a limit switch positioned to be actuated when said handle means is in said down position and a solenoid responsive to said limit switch for initiating dispensing of material from said material dispenser means.

7. A manually operated portion packaging apparatus as recited in claim 6 further comprising:

a timer coupled to said limit switch and activated by activation of said limit switch, said timer indicating a passage of time sufficient for said sealing means to be in said operable condition to seal a container and for said material dispenser means to dispense said predetermined amount of material.

8. A manually operated portion packaging apparatus as recited in claim 7 wherein:

said frame means includes a pair of generally planar, elongated siderails, said sealing means and said handle means being coupled across said pair of siderails.

9. A manually operated portion packaging apparatus as recited in claim 7 wherein said plates are coupled to said drive chains by a single connection on each side of said plate thereby permitting said conveyor chain to follow a radius of curvature substantially limited by said drive chain and not by said plates and permitting the leading and lagging edges of said plates to separate from said drive chain when said drive chain traverses a sufficiently small radius of curvature.

10. A manually operated portion packaging apparatus for denesting, filling and sealing of a container in a sequential series of manually initiated step operations, said portion packaging apparatus including:

a handle means positionable between a first and a second position for initiating said step operations, a complete cycle of said handle means including movement of said handle means from said first position to said second position and back to said first position, said cycle being repeated for sequential operations of said portion packaging apparatus;

a rotatable endless conveyor means having a plurality of container receiving means therein and movable in a downstream direction;

coupling means for intermittently moving said conveyor means one step in response to movement of said handle means from one of said positions to the other of said positions;

a container dispenser means positioned above one of said container receiving means when said handle means is in one of said positions and coupled to said handle means so that one container is released as said handle is moved between said positions;

a material dispenser means positioned above an other of said container receiving means while said container dispenser means is positioned above said one container receiving means and coupled to said handle means so that when said handle is in said other of said positions, a predetermined quantity of the material from said material dispenser means is released and deposited in said other container carried by said conveyor chain;

a sealing means for closing a filled container, said sealing means including a sealing film dispenser for positioning a sealing film on still an other container while said container dispensing means is positioned above said one container receiving means, said sealing means also including a heating element for applying heat to said sealing film positioned on a container, said heating element being coupled to said handle means so said heating element is in an inoperable position displaced from said sealing film when said handle means is in said one of said positions and said heating element is in an operable position contacting said sealing film when said handle means is in the other of said positions; and a cutter means for cutting said sealing film downstream of said operable position of said heating element, said cutter means coupled to said handle means so as to be positioned in an inoperable position displaced from said sealing film when said handle means is in said one of said positions and positioned in an operable position adjacent said sealing film when said handle means is in the other of said positions.

11. A manually operated portion packaging apparatus as recited in claim 10 wherein:

said portion packaging apparatus includes a frame means for mounting said handle means and said conveyor means;

said conveyor means includes a pair of parallel, spaced drive chains and a plurality of generally rectangular plates supported between said pair of drive chains, said plates including said container receiving means; and said coupling means includes a sprocket wheel mounted on said frame means and engaging at least one of said drive chains for transmitting a driving force to said conveyor means, a ratchet rotationally coupled to said sprocket wheel, a pawl for engaging and driving said ratchet, and a lever means for coupling said pawl to said handle means so that movement of said handle from said one position to the other causes said ratchet to turn sufficiently to move said conveyor means downstream the distance between the centers of adjacent container receiving means.

12. A manually operated portion packaging apparatus as recited in claim 10 wherein said coupling means further includes:

a stop means for releasing said ratchet from said pawl, said stop means being positioned to release said ratchet when said ratchet has turned sufficiently to move said conveyor means the distance between the centers of adjacent container receiving means; and a spring means for biasing said pawl toward said ratchet, said spring means being coupled between said pawl and said lever means.

13. A manually operated portion packaging apparatus as recited in claim 10 wherein:

said heating element is pivotally coupled to said frame means and spring biased to said inoperable position; and said handle means includes a crossbar which engages said heating element when said handle means is moved from said one to said other position thereby pivoting said heating element to said operable position.

14. A manually operated portion packaging apparatus as recited in claim 10 wherein:

said container dispenser means is coupled by a cable to said handle means so that movement of said handle means through a complete cycle releases one container to be positioned in said one of said container receiving means in said conveyor means.

15. A manually operated portion packaging apparatus as recited in claim 10 wherein:

said material dispenser means includes a limit switch positioned to be actuated when said handle means is in said other position and a solenoid responsive to said limit switch for initiating dispensing of material from said material dispenser means.

16. A manually operated portion packaging apparatus as recited in claim 15 further comprising:

a timer coupled to said limit switch and activated by activation of said limit switch, said timer indicating a passage of time sufficient for said sealing means to be in said operable condition to seal a container and for said material dispenser means to dispense said predetermined amount of material.

17. A manually operated portion packaging apparatus as recited in claim 16 wherein:

said frame means includes a pair of generally planar, elongated siderails, said sealing means and said handle means being coupled across said pair of siderails.

18. A manually operated portion packaging apparatus as recited in claim 16 wherein:

said plates are coupled to said drive chains by a single connection on each side of said plate thereby permitting said conveyor chain to follow a radius of curvature substantially limited by said drive chain and not by said plates and permitting the leading and lagging edges of said plates to separate from said drive chain when said drive chain traverses a sufficiently small radius of curvature.

* * * * *